United States Patent [19]

Whitney Jr.

[11] Patent Number: 4,843,779

[45] Date of Patent: Jul. 4, 1989

[54] STRAP ANCHOR FOR METAL STUD/BRICK VENEER WALL CONSTRUCTION

[76] Inventor: G. Ward Whitney Jr., 2129 Lockhart Dr., Charlotte, N.C. 28203

[21] Appl. No.: 179,055

[22] Filed: Apr. 8, 1988

[51] Int. Cl.[4] ..... E04B 1/41

[52] U.S. Cl. ..... 52/714; 52/379

[58] Field of Search ..... 52/378, 379, 383, 712, 52/714, 351, 359

[56] References Cited

U.S. PATENT DOCUMENTS

| | | | |
|---|---|---|---|
| 1,027,632 | 5/1912 | White | 52/359 |
| 1,646,312 | 10/1927 | Perkins | 52/714 |
| 2,048,236 | 7/1936 | Venzie | 52/359 |
| 2,061,150 | 11/1936 | Goss | 52/351 |
| 2,785,099 | 3/1957 | Holtsford | 52/486 X |

*Primary Examiner*—David A. Scherbel
*Assistant Examiner*—Anthony W. Williams
*Attorney, Agent, or Firm*—Brumbaugh, Graves, Donohue & Raymond

[57] ABSTRACT

A strap anchor for metal stud/brick veneer wall construction includes a first end portion adapted to be embedded in a mortar joint of the veneer wall and a second end portion having a specially shaped slot that permits the anchor to be hooked onto the front L-shaped flange of the stud with edges of the slot engaging portions of both lateral surfaces and internal and external portions of the front flange of the stud.

3 Claims, 2 Drawing Sheets

STRAP ANCHOR FOR METAL STUD/BRICK VENEER WALL CONSTRUCTION

BACKGROUND OF THE INVENTION

Brick has long been a popular facing material for residential and commercial buildings. It is strong, durable, non-combustible and weather-resistant and requires little maintenance. Commonly, brick wall facing is provided in the form of a veneer wall. In a veneer wall, by definition, the facing is securely attached to a back-up structure but is not united with it such as to act in concert with the back-up in bearing applied loads.

A widely used back-up wall for commercial buildings is one based on steel studs, a gypsum wallboard exterior sheathing and a rigid plastic foam insulation applied over the sheathing. The brick veneer facing wall is carried on structural steel shelf angles at each story and is secured to the back-up wall, with an air space of 1" to 3" between it and the back-up wall, by anchors (sometimes called wall ties) located at 16-inch spacing vertically and either 16" or 24" spacing horizontally. The anchors are critical elements of the system, for they must support the veneer wall by transfer of lateral loads from the veneer wall to the back-up wall. Failure of the anchors means failure of the wall.

One type of anchor is a simple metal band corrugated transversely and bent into an "L" shape. The end portion of one leg of the "L" is embedded in a horizontal mortar joint of the brick veneer wall, and the other leg is fastened to the steel stud by screws. Another type of anchor comprises a slotted bracket that is welded or fastened by screws to the stud and receives a wire anchor member in a manner that allows vertical adjustment and movement of the anchor relative to the bracket.

The use of screws to fasten the anchor to the studs has recently been questioned. The presence of moisture due to leakage and condensation is inevitable, and corrosion of the screw threads is likewise inevitable. Corrosion-resistant coatings on the screws are disturbed when the screws are driven. Working of the screws weakens their hold to the stud. While welding provides the requisite strength, it is costly and requires complicated notching of the sheet rock and insulation, to expose the brackets. (Often, screw-fastened brackets are fastened on the face of the sheathing, which makes installation easier but also undesirably loads the sheathing and the screws.)

In *Technical Notes on Brick Construction,* No. 28B, Revised II, Feb. 1987, of the Brick Institute of America, Reston, Va., two designs for anchors are proposed in which one anchor element, either a wire or a plate, is fitted to the stud flange and a second element is attached to the first for vertical adjustment and movement and is embedded in the mortar joint. While those designs should provide longlife, as compared to screws, they are cumbersome in use, in that the first element has to be assembled to the stud before the stud is assembled to the back-up wall. In other words all of the anchor elements, which will usually be six or more, that are fitted to the stud have to be placed on the stud before the stud is erected. The chance of errors and omissions is great.

SUMMARY OF THE INVENTION

An object of the invention is to provide an anchor for a metal stud/brick veneer wall that properly secures the veneer wall to the studs without any screws and without pre-assembly to the studs before they are erected. Another object is to provide an anchor that is easy to install. Yet a further object is to provide an anchor that can be manufactured economically with machinery currently used by suppliers and relatively inexpensive tooling.

The foregoing and other objects are met, in accordance with the present invention, by a strap anchor in the form of an elongated metal strip having a first end portion adapted to be embedded in a mortar joint of a brick veneer wall, a medial portion adapted to span and maintain a space between a metal stud and the brick veneer wall, and a second end portion adapted to engage a web portion and an L-shaped exterior flange portion of the metal stud, which flange portion includes a base leg part and an inturned leg part. The second end portion of the strap has a slot opening at its extremity and having first and second edge portions orthogonal to each other and adapted to engage external surfaces of the web and the base leg part of the stud adjacent their juncture, a third edge portion adapted to engage the external surface of the inturned leg part of the stud and a fourth edge portion adapted to engage the internal surface of the base leg part of the stud. The slot has a width throughout its extent not less than the width of the inturned leg part of the stud so that the anchor can be installed on the stud by first guiding it endwise laterally of the stud to accept the flange portion in the slot and then displacing and rotating it to seat the flange portion of the stud within the slot.

In preferred embodiments the medial portion of the anchor has at least one lengthwise corrugation for enhanced stiffness, and the first end portion has at least one transverse corrugation for enhanced retention in the mortar joint.

For a better understanding of the invention reference may be made to the following description of an exemplary embodiment of the invention, taken in conjunction with the figures of the accompanying drawings.

DESCRIPTION OF THE EMBODIMENT

Figure 1:
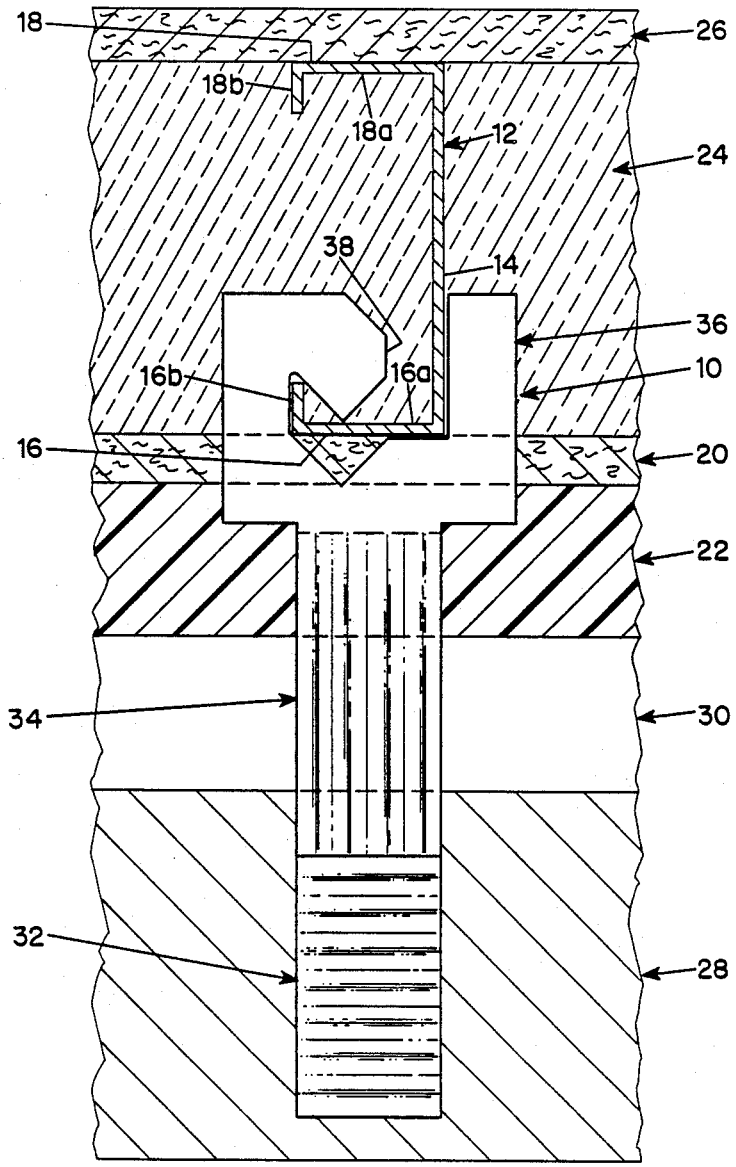
FIG. 1 is a fragmentary horizontal cross-sectional view of a wall employing the embodiment.
Figure 2:
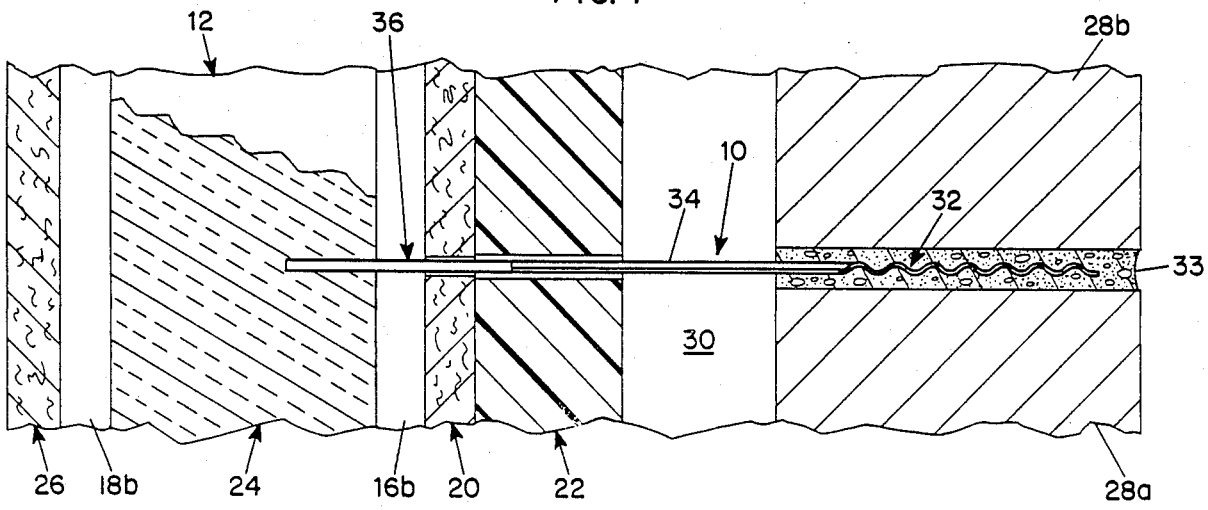
FIG. 2 is a fragmentary vertical cross-sectional view of the wall of FIG. 1.
Figure 3:
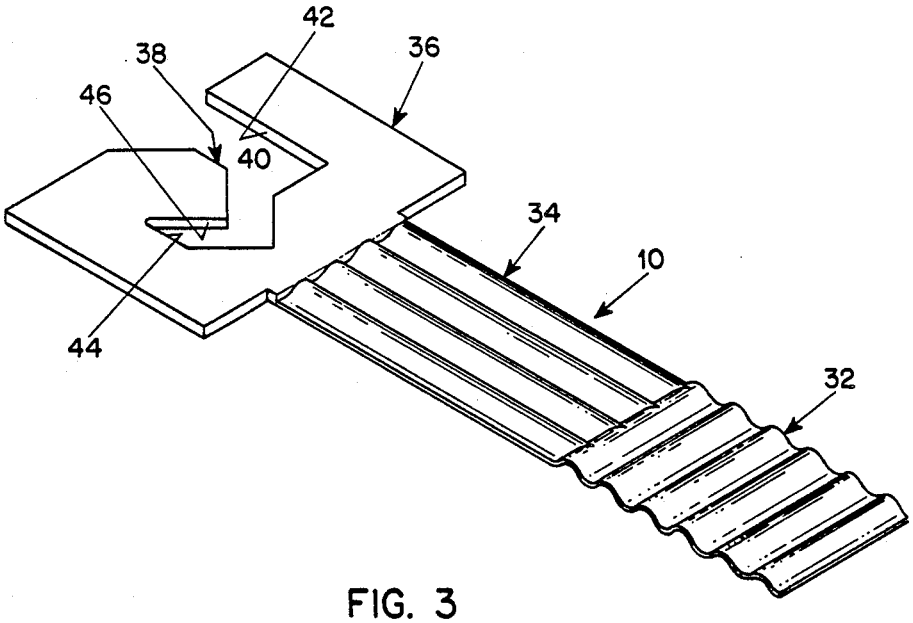
FIG. 3 is a pictorial view of the embodiment.

FIGS. 1 and 2 show a strap anchor 10 embodying the invention in place in a typical metal stud/brick veneer back-up wall. The back-up wall is constructed of vertical metal studs 12 installed on 16" or 24" centers between the adjacent floors at the building perimeter. Each stud comprises, in cross-section, a web portion 14 and a pair of L-shaped flange portions 16 and 18. Each flange portion includes a base leg part **16*a*, 18*a* and an inturned leg part 16*b*, 18*b*. Sixteen-inch by eight-foot asphalt impregnated gypsum wallboard sheathing panels 20 are installed horizontally on the exterior of the studs using sheathing screws, and 16"×4' rigid plastic insulation panels 22 are installed over the sheathing using an adhesive or screws. The joints between the sheathing and the insulation panels establish the 16" vertical spacing for the anchors 10**, which are located on each stud at each sheathing/insulation joint; the 16"

or 24" spacings of the studs establish the required 16" or 24" horizontal spacing of the anchors 10. Fiber batt insulation blankets 24 are installed between the studs, and the interior wall is finished with interior gypsum wallboard panels 26.

The brick veneer wall 28 is constructed on a structural steel shelf angle (not shown) at each floor except that the ground floor veneer wall is usually located on a foundation shelf. Flashing and weep holes at the bottom of each veneer wall section allow water that intrudes by leakage or forms from condensation to exit the air space 30 between the back-up wall and the veneer wall.

The strap anchor 10 is an elongated metal strip having at its outer end a portion 32 that is embedded in the horizontal mortar joint 34 between courses 28*a* and 28*b* of the brick veneer wall 28 (FIG. 2). The embedded portion is preferably corrugated transversely for enhanced retention in the joint. A medial portion 34 spans and maintains the air space 22 and is preferably corrugated in a direction orthogonally to the wall (i.e., lengthwise of the strap) for enhanced stiffness. Instead of the corrugations in the portions 32 and 34 ribs formed by concavities pressed into the strap or flanges bent at right angles to the strap along the edges of the medial portion 34 and at the end of the portion 32 can be provided.

The inner end portion 36 of the strap is wider than the portions 32 and 34 and has a specially shaped slot 38 that permits the strap to be attached directly to the stud 12 without screws, welds or similar fasteners. The slot 38 opens at the extremity of the portion 36 and is shaped to define first and second edge portions 40 and 42 that engage the external surfaces of the front base leg part 16*a* and the web portion 14 of the stud, a third edge portion 44 that engages the external surface of the inturned leg part 16*b* of the stud and a fourth edge portion 46 that engages the internal surface of the base leg part 16*a*. The slot has a width throughout its extent that is not less at any point than the width of the inturned leg part 16b of the stud so that the anchor can be installed on the stud after the stud is in place in the wall.

Figure 4A:
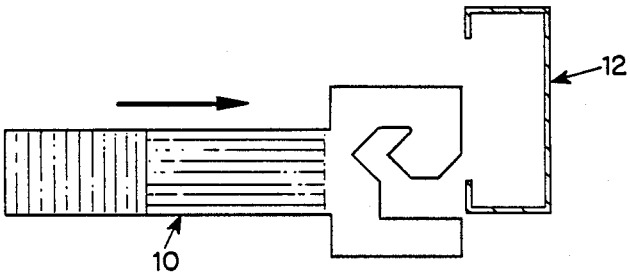
FIGS. 4A to 4D are diagrammatic views showing how the anchor is installed on the stud.
Figure 4B:
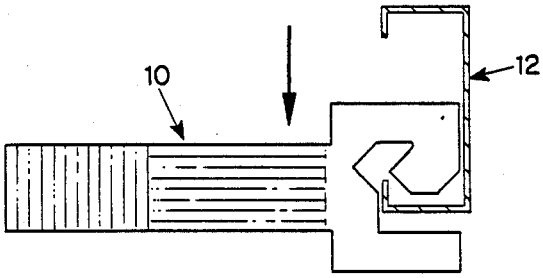
Figure 4C:
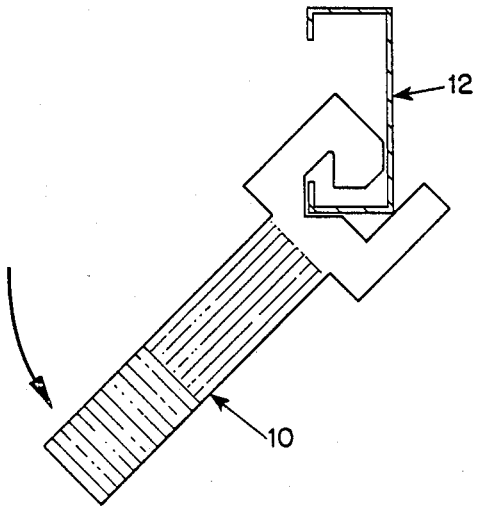
Figure 4D:
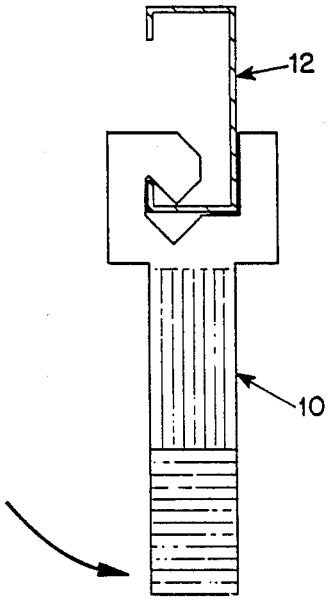

In particular, FIGS. 4A to 4D depict the procedure for installing the strap, to wit: the strap is guided endwise laterally of the stud (FIG. 4A) such that the flange portion 16 is accepted in the slot 38 (FIG. 4B), is then moved outwardly (FIG. 4B), and is lastly rotated into the installed position (FIGS. 4C and 4D).

Loads on the brick veneer wall 28 in a direction away from the back-up wall, which are small, are transferred from the strap to the stud at the zones of engagement between the edge portion 46 on the internal service of the base leg part 16*a* of the stud and the internal corner between edge portions 44 and 46 on the free edge of the inturned leg part 16B of the stud. Despite a limited area of engagement and the location of that area remote from the web portion of the stud, there is adequate stiffness in the connection to bear the relatively small outward loads on the veneer wall and the second edge portion 42 restrains the rotation of the stud from the eccentric load.

Loads on the veneer wall toward the back-up wall are transferred at the zone of engagement between the edge portion 40 of the slot 38 and the base leg part 16*a* of the stud. Although the load transfer zone is eccentric to the longitudinal axis of the portions 32 and 34 of the anchor, those portions have great lateral and longitudinal stiffness. The zone of engagement is, moreover, in the region of the web portion of the stud, a region of high stiffness. Hence, the anchor provides excellent stability to the veneer wall.

The strap is, preferably, produced by roll-forming and cutting from 16 gauge steel strip. By making the stud end (attachment portion 36) twice the width of the medial and veneer end portions 34 and 32, two sets of straps can be produced from the strip, the stud ends 36 of the respective sets being arranged on opposite edges of the strip and the portions 32 and 34 of the respective sets being arranged side by side alternately along the center portion of the strip.

I claim:

1. A strap anchor for metal stud/brick veneer wall construction in the form of an elongated metal strip having a first end portion adapted to be embedded in a mortar joint of a brick veneer wall, a medial portion adapted to span and maintain a space between a metal stud and the brick veneer wall, and a second end portion adapted to engage a web portion and an L-shaped exterior flange portion of the metal stud, which flange portion includes a base leg part and an inturned leg part, the second end portion of the strip having a slot opening at the lengthwise extremity of the second end portion and having first and second edge portions orthogonal to each other and adapted to engage external surfaces of the web and the base leg part adjacent that juncture, a third edge portion adapted to engage the external surface of the inturned leg part, a fourth edge portion adapted to engage the internal surface of the base leg part, and edges defining a V-shaped portion of the slot and intersecting the second, third and fourth edges, the slot having a width throughout its extent not less than the width of the inturned leg part of the stud so that the anchor can be installed on the stud by first guiding it endwise laterally of the stud to accept the flange portion in the slot and then displacing and rotating it to seat the flange portion of the stud within the slot .

2. An anchor according to claim 1 wherein the medial portion has at least one lengthwise corrugation for enhanced stiffness.

3. An anchor according to claim 1 wherein the first end portion has at least one transverse corrugation for enhanced retention in the mortar joint.

* * * * *